US006453552B1

(12) United States Patent
Chavez, Jr. et al.

(10) Patent No.: US 6,453,552 B1
(45) Date of Patent: Sep. 24, 2002

(54) METHOD OF MANUFACTURING ELECTRICAL TERMINALS AND TERMINAL MODULES

(75) Inventors: Jose H. Chavez, Jr., Romeoville; Gary M. Comstock, LaGrange; Arvind Patel, Naperville; Timothy E. Purkis, Naperville; Yew Teck Yap, Naperville, all of IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 09/016,851

(22) Filed: Jan. 30, 1998

(51) Int. Cl.[7] ..... H01R 43/00

(52) U.S. Cl. ..... 29/884; 29/874; 29/883; 29/566.2; 439/606

(58) Field of Search ..... 29/883, 884, 874, 29/876, 827, 841, 566.2; 439/885, 606

(56) References Cited

U.S. PATENT DOCUMENTS 4,021,095 A 5/1977 Kinkaid et al.
4,345,372 A 8/1982 Sekigawa et al. ..... 29/874
4,428,642 A 1/1984 Schwindt et al.
4,442,594 A 4/1984 Narozny ..... 29/884
4,547,964 A 10/1985 Amano et al. ..... 29/883
4,593,463 A * 6/1986 Kamono et al. ..... 29/884

* cited by examiner

*Primary Examiner*—Rick Chang
(74) *Attorney, Agent, or Firm*—Stephen Z. Weiss

(57) ABSTRACT

A method of manufacturing electrical terminals and/or a terminal module is disclosed. The method includes the steps of stamping from a sheet of metal material a blank for a plurality of elongated terminals having contact portions at one end and terminal portions at the other end and joining the terminals by a tie bar intermediate the ends. The contact portions of the respective terminals are separated from each other by the stamping step. The terminal portions remain joined in the sheet of metal after the stamping step. The blank then is sheared to separate the terminal portions. The tie bar is cut to separate the terminals. In order to form a terminal module, a dielectric housing is overmolded about the terminals intermediate the ends thereof, with the tie bar being located outside the housing and removed after the overmolding process.

4 Claims, 6 Drawing Sheets

METHOD OF MANUFACTURING ELECTRICAL TERMINALS AND TERMINAL MODULES

FIELD OF THE INVENTION

This invention generally relates to the art of electrical connectors and, particularly, to the terminals for such connectors. Specifically, the invention relates to a method of manufacturing or fabricating electrical terminals, including terminals used in a terminal module.

BACKGROUND OF THE INVENTION

A typical electrical connector includes an insulating or dielectric housing which mounts a plurality of terminals. The connector is mateable with a complementary mating connector or other connecting device wherein the terminals engage or mate with the terminals of the complementary connector.

It is well known in the prior art to manufacture the terminals for electrical connectors by stamping and forming the terminals from a continuous sheet or strip of metal material. During the stamping or punching operation, portions of the sheet metal material are removed, leaving the profiles of the terminals which subsequently are formed into their desired configurations. The terminals typically are joined by a carrier strip and/or a tie bar of the sheet metal material to facilitate moving the material through a sequence of processing stations and to facilitate subsequent fabrication operations. For instance, the stamped and formed terminals may be transported to a processing station whereat the terminals are overmolded by a dielectric housing to form a terminal module. The entire module, including the overmolded terminals, then can be unitarily inserted into an electrical connector housing.

Because of the ever-increasing miniaturization of electrical connectors and the continuing demand for high density terminal arrays, stamping and forming processes continue to create barriers in achieving these goals. One problem involves the stamping or punching operation, itself. As stated above, when the sheet metal material is stamped into a blank of a desired configuration to subsequently form the terminals, sheet metal material inherently is removed from between the terminals, leaving their desired profiles. Therefore, the density or pitch between the respective terminals is limited by the widths of the punching tool portions and the width of the terminal portion or solder pad and the resultant strength of the solder joint formed being reduced. In other words, the terminals cannot be stamped in positions immediately adjacent to each other. The present invention is directed to solving these problems by a manufacturing method which includes a sequence of fabricating steps including both stamping and shearing processes which results in higher density terminal arrays and/or wider terminal portions because metal material is not removed between the portions.

SUMMARY OF THE INVENTION

An object, therefore, of the invention is to provide a new and improved method of manufacturing electrical terminals, including a terminal module.

In the exemplary embodiment of the invention, the method, generally, includes the steps of stamping from a sheet of metal material a blank for a plurality of elongated terminals having contact portions at one end and terminal portions at the other end and joining the terminals by a tie bar intermediate the ends. The contact portions of the respective terminals are separated from each other by the stamping step. The terminal portions remain joined in the sheet metal material. The blank then is sheared to separate the terminal portions. The tie bar then is removed to separate the terminals.

The invention also contemplates a method of manufacturing a terminal module using the steps outlined above. In particular, a dielectric housing is overmolded about the terminals intermediate the ends thereof, with the tie bar being located outside the housing. The tie bar subsequently can be cut to separate the terminals to insulatingly isolate the terminals by the dielectric housing.

As disclosed herein, the method includes the step of forming at least some of the terminals out of the plane of the sheet metal material after the shearing step. Specifically, the terminal portions of the terminals are formed such that alternating terminal portions are disposed in one plane and the remaining alternating terminal portions are disposed in a second plane. At least some of the terminal portions are formed to one side of the sheet metal material. With the terminal portions in two planes, the portions can be used as solder pads for engaging circuit traces on opposite sides of a printed circuit board at the edge thereof.

Still further, the preferred embodiment illustrated herein includes a carrier strip joining one end of the terminals after the stamping step, with finger portions projecting inwardly from the carrier strip. During the forming step, the finger portions are formed out of the plane of the sheet metal material on the same side thereof as some of the terminal portions. Thereby, the finger portions provide support for a transport sheet and protect the formed terminal portions.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
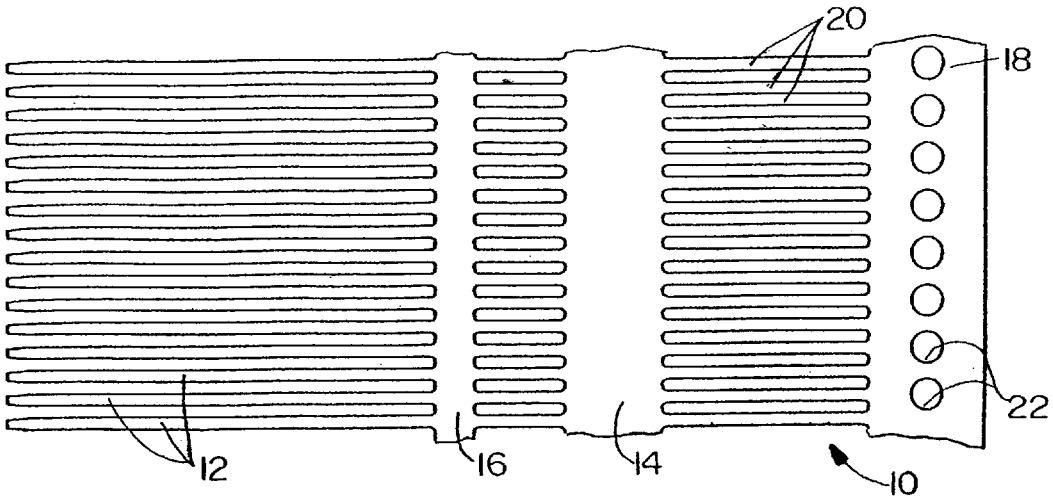
FIG. 1 is a plan view of a blank stamped from sheet metal material according to the first step in the method of the invention.

Referring to the drawings in greater detail, FIG. 1 shows a blank, generally designated 10, which has been stamped or punched from a continuous sheet or strip of metal material in an initial step of the manufacturing method of the invention. The stamping process removes metal material to leave a profile which includes a plurality of elongated legs 12 which eventually will be formed into the contact portions a plurality of elongated terminals. The terminals will include terminal portions at the opposite ends thereof which are formed from a continuous web 14 of the sheet metal material. A continuous tie bar 16 joins legs 12. A continuous carrier strip 18 is joined by fingers 20 to continuous web 14. Essentially, fingers 20 are in line with legs 12. A line of indexing holes 22 are punched in carrier strip 18 to facilitate moving the blank through sequential stations of a continuous punching press as is known in the art.

Figure 2:
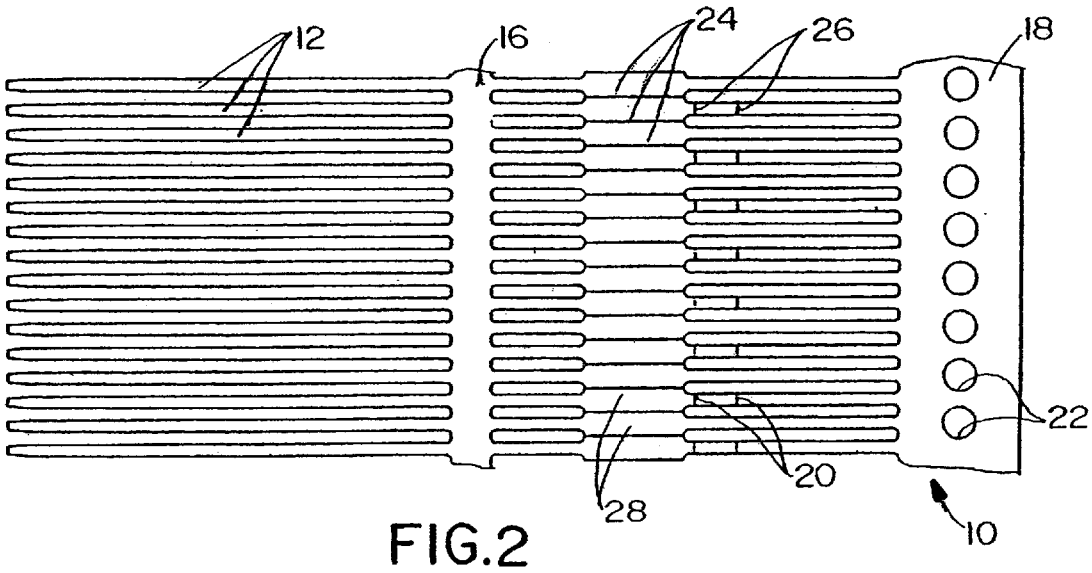
FIG. 2 is a plan view of the blank after the shearing step.

Blank 10 then is fed to a shearing station whereat the continuous web 14 (FIG. 1) is sheared at lines 24 in FIG. 2, and alternate fingers 20 are sheared at lines 26. The sheet metal material between shear lines 24 eventually will be formed into terminal portions of the elongated terminals. It can be understood from FIG. 2 that, in the shearing process, material is not removed from the sheet metal as in a stamping or punching process. In other words, shear lines 24 and 26 are made by shearing blades in a "scissors" type action, leaving terminal portions 24 immediately adjacent each other. This allows for the terminal portions to be as wide as possible. A wire terminal portion may result in a stronger solder joint or a more secure sliding contact engagement than would be available with the narrow terminal portion formed from a stamping and not shearing operation.

Figure 3:
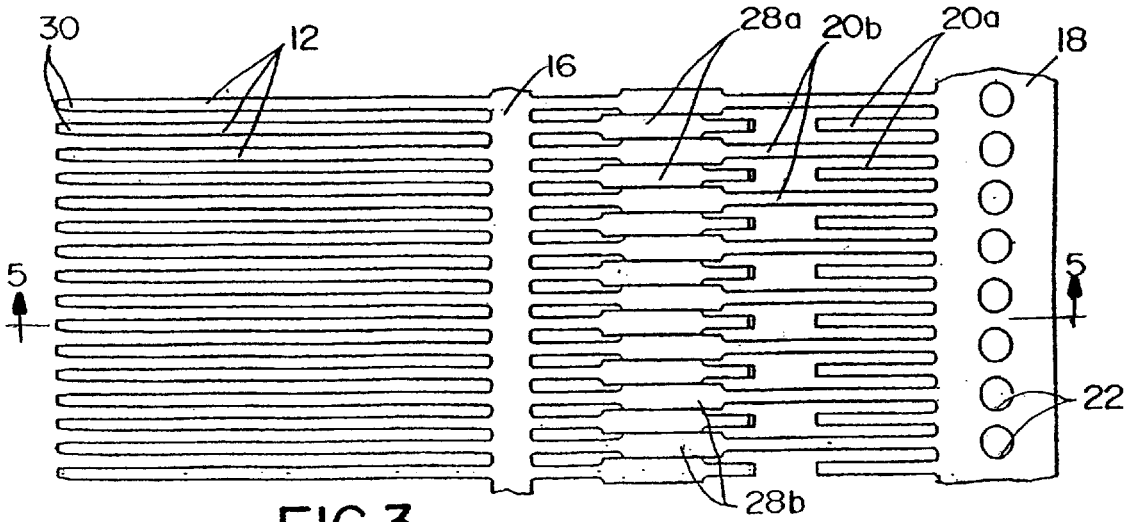
FIGS. 3 and 4 are plan views, respectively, of the blank after the forming step.
Figure 4:
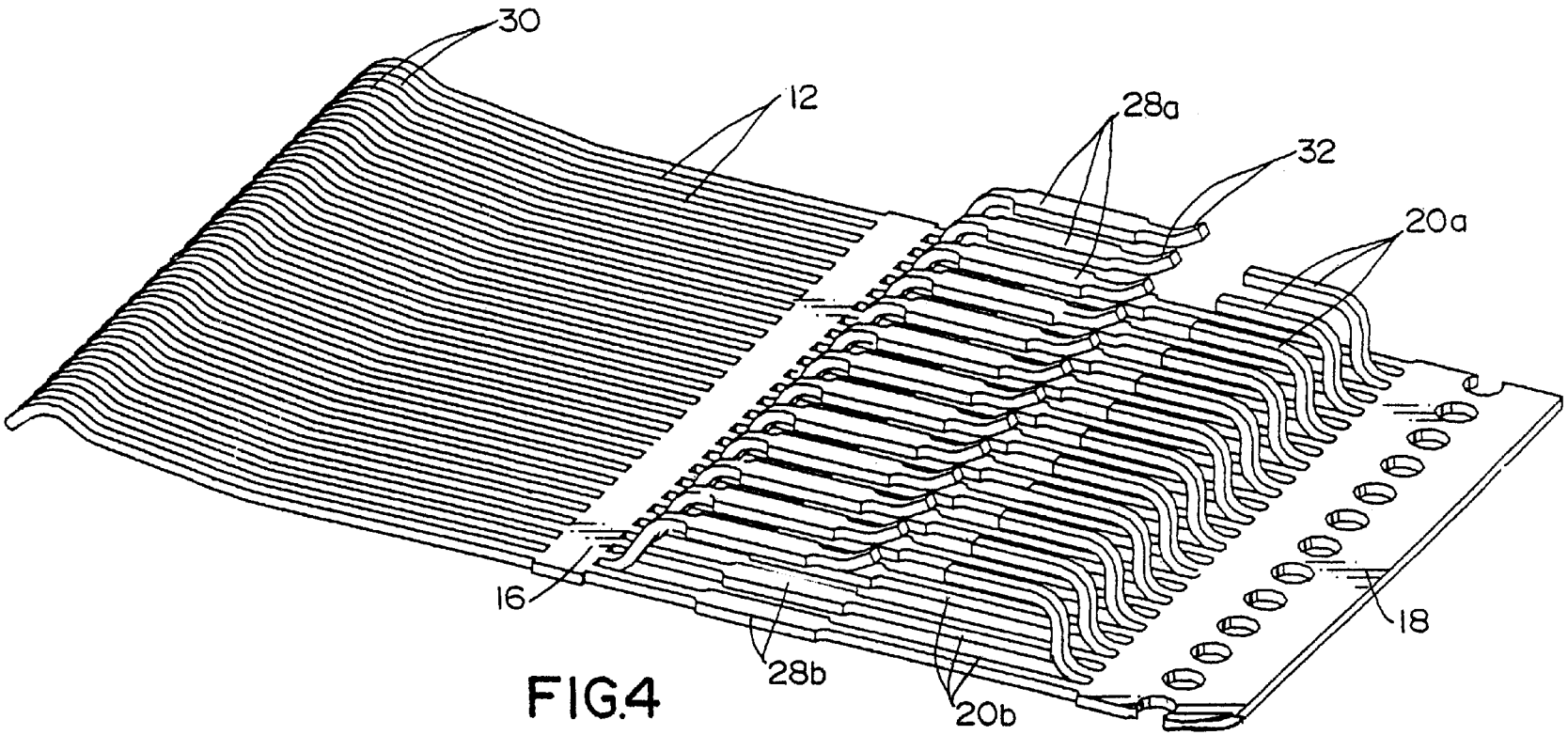
Figure 5:
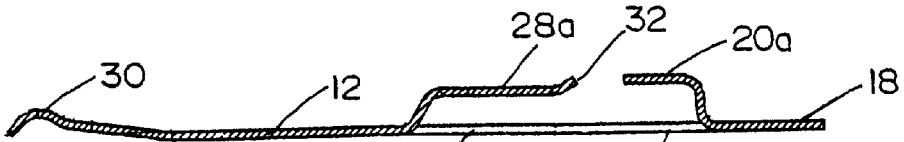
FIG. 5 is a section taken generally along line 5—5 of FIG. 3.

The stamped and sheared blank of FIG. 2 then is formed as shown in FIGS. 3–5. Specifically, the distal ends of legs 12 are formed out of the plane thereof to define rounded contact portions or surfaces 30. Alternating terminal portions 28*a* are formed out of the plane of the sheet metal material to be disposed in one plane, while the remaining alternating terminal portions 28*b* remain in their original plane. Therefore, alternating terminal portions 28*a,* in essence, are in a first plane and alternating terminal portions 28*b* are in a second plane. Alternate terminal portions 28*b* still are joined to carrier strip 18 by alternating fingers 20*b,* while the remaining alternating fingers 20*a* (which have been sheared from terminal portions 28*a*) have been formed out of the plane of the sheet metal material so that they lie substantially in the plane of terminal portions 28*a*. Finally, the tips or distal ends of terminal portions 28*a* are formed to flare upwardly or outwardly, as at 32.

The stamped and formed blank shown in FIGS. 3–5 then can be transported to subsequent stations for further fabrications and/or assembly into electrical connectors. During such transport, the continuous stamped and formed metal strip may be wound on a reel and separated by paper-like material or transport sheet. Formed fingers 20*a* and formed terminal portions 28*a* form points of a plane upon which a first surface of the transport sheet may rest determining formed fingers 20*b* and alternate terminal portions 28*b* form points of a plane upon which a second surface of the transport sheet may rest.

Figure 6:
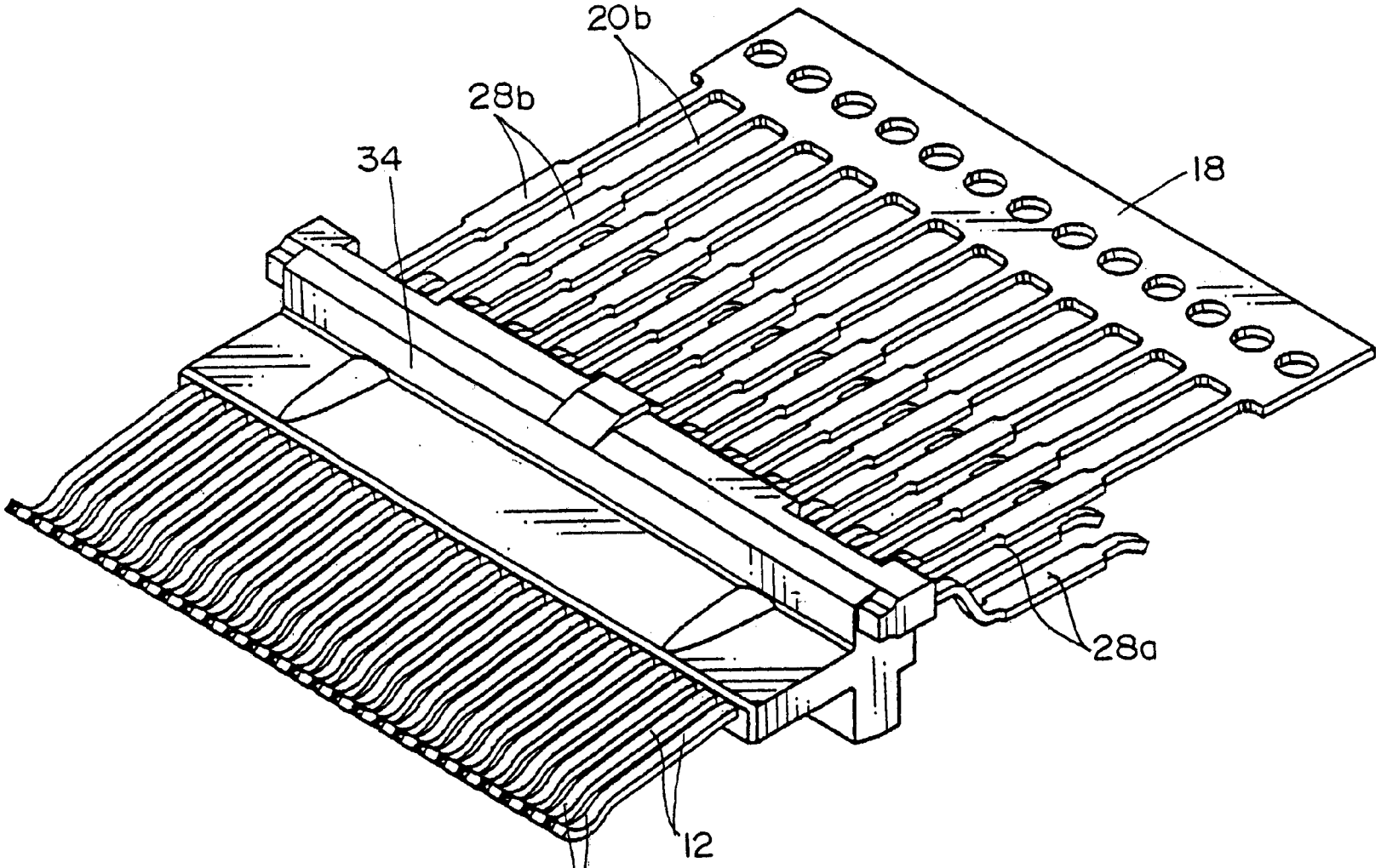
FIG. 6 is a perspective view of the stamped and formed blank having the overmolded dielectric housing thereabout to form a terminal module.
Figure 7:
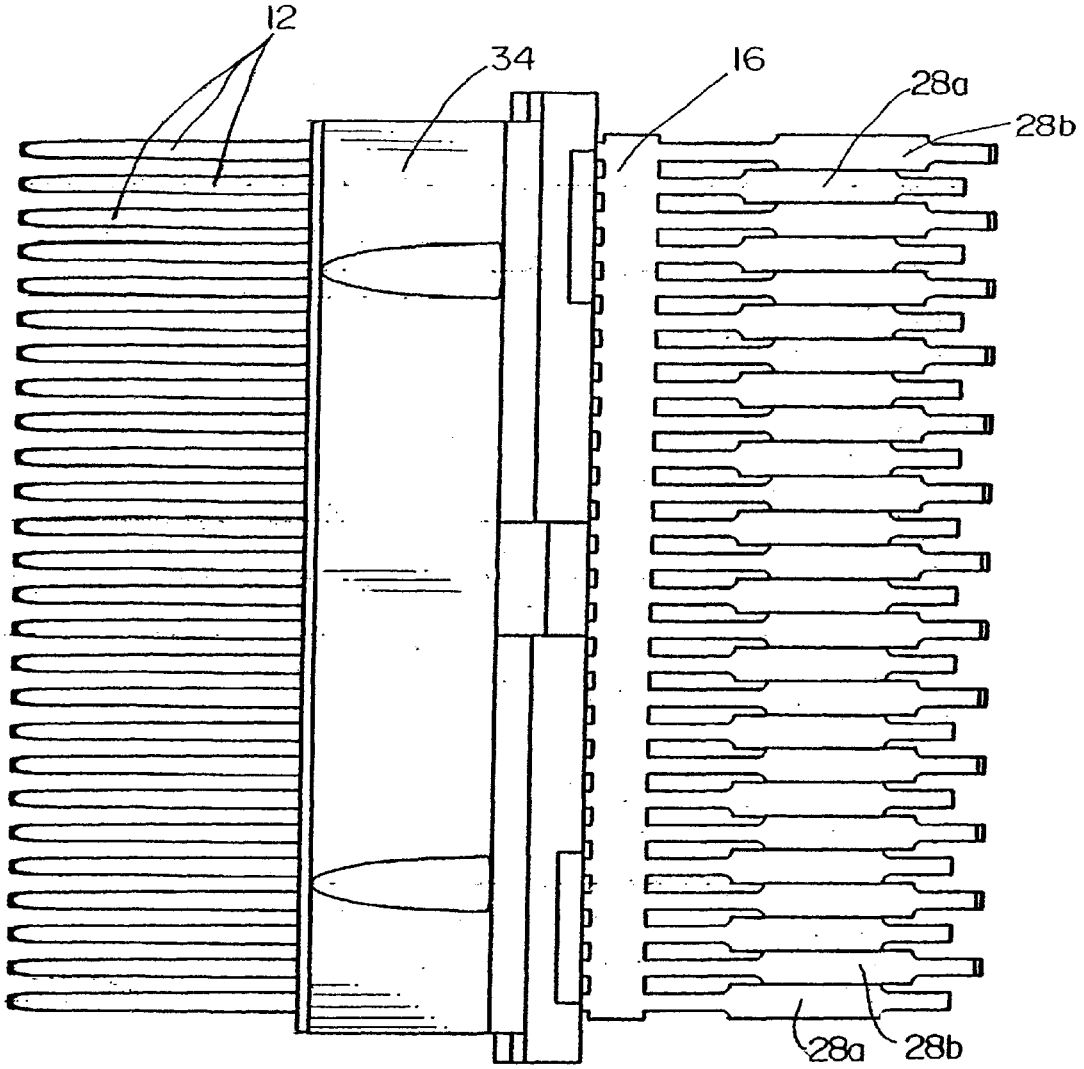
FIG. 7 is a plan view of the assembly of FIG. 6, with the carrier strip removed.
Figure 8:
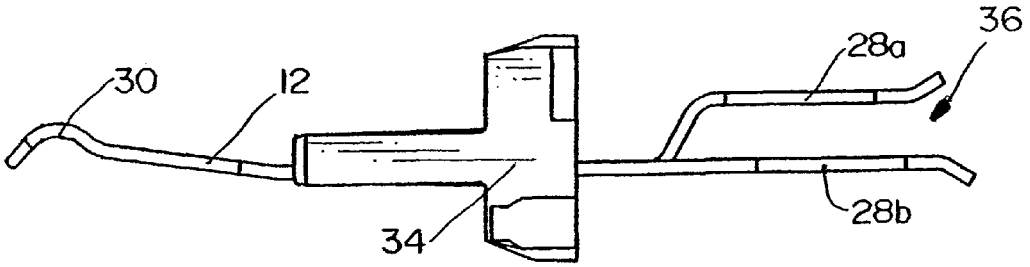
FIG. 8 is a view similar to that of FIG. 7.

The invention contemplates that the terminals manufactured by the steps outlined above can be further fabricated into a terminal module for unitary assembly within an electrical connector. More particularly, FIGS. 6–8 show a dielectric housing 34 which has been overmolded about portions of legs 12 between contact portions 30 and tie bar 16. The overmolded housing is effective to electrically insulate the terminals and to rigidly join the terminals into a module for subsequent assembly into an electrical connector.

Either before or after the overmolding process, support fingers 20*a* (FIGS. 3–5) are removed by an appropriate cutting operation, as illustrated in FIG. 6. Carrier strip 18 also is removed as illustrated in FIGS. 7 and 8. Tie bar 16 also is removed by cutting between the legs 12 forming electrically separate terminals and leaving a completed terminal module 36.

Finally, FIG. 9 shows how terminal module 36 (FIG. 8) might be used in an electrical connector. Specifically, the terminal module is inserted into the rear of a dielectric or insulating housing 40 such that terminal portions 30 are disposed within a forwardly projecting plug portion 42 of the housing, and terminal portions 28*a* and 28*b* projecting rearwardly between wing portions 44 of the housing. As stated above, terminal portions 28*a* and 28*b* are disposed in different planes and, thereby, define a mouth therebetween and into which a narrow circuit board 48 is inserted in the direction of arrows "A". Therefore, terminal portions 28*a* (28*b*) form solder pads for soldering to a plurality of parallel conductors or circuit traces 48*a* on opposite sides of circuit board 48.

Figure 9A:
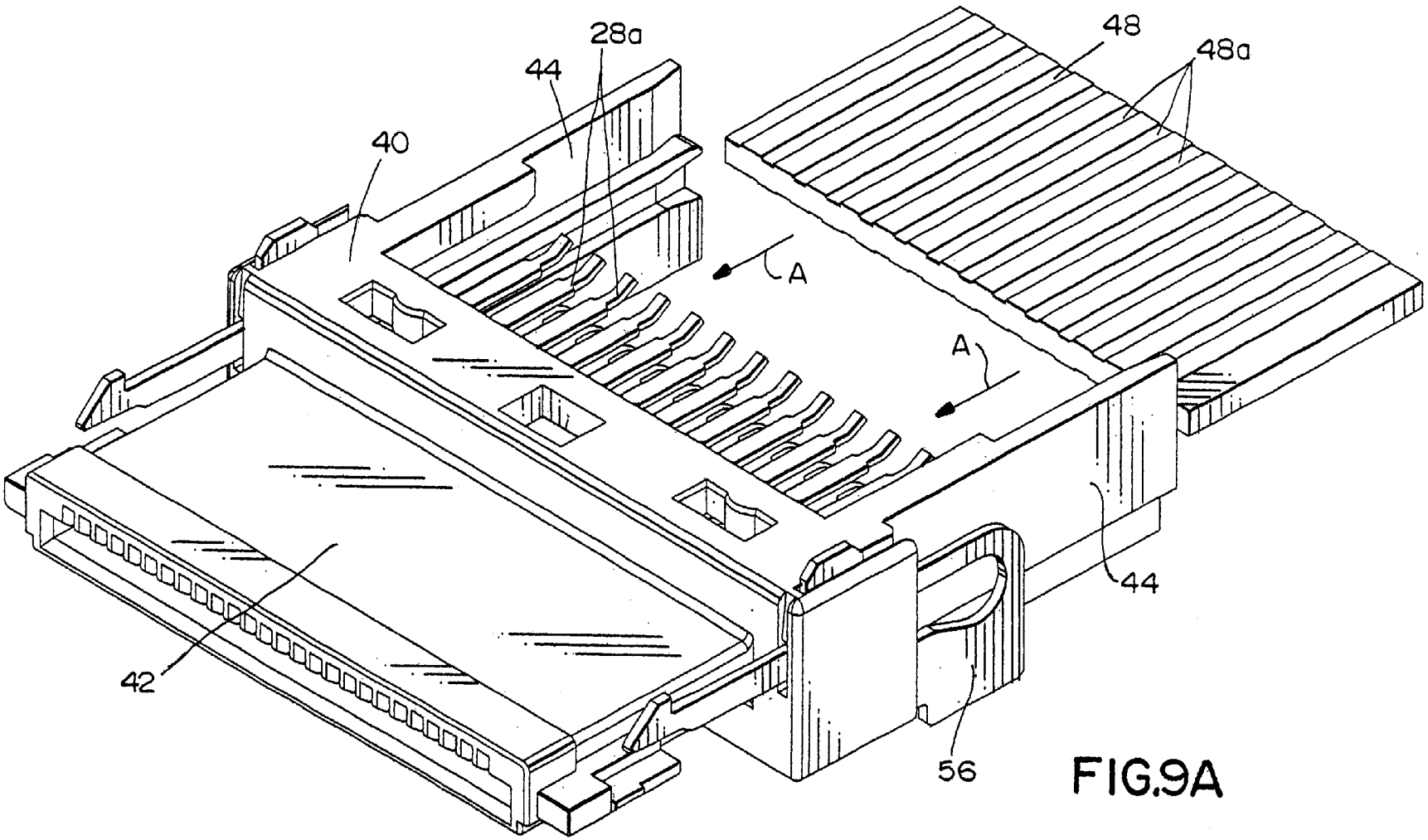
FIGS. 9A and 9B shows an exploded perspective view of a type of connector within which the terminal module might be used.
Figure 9B:
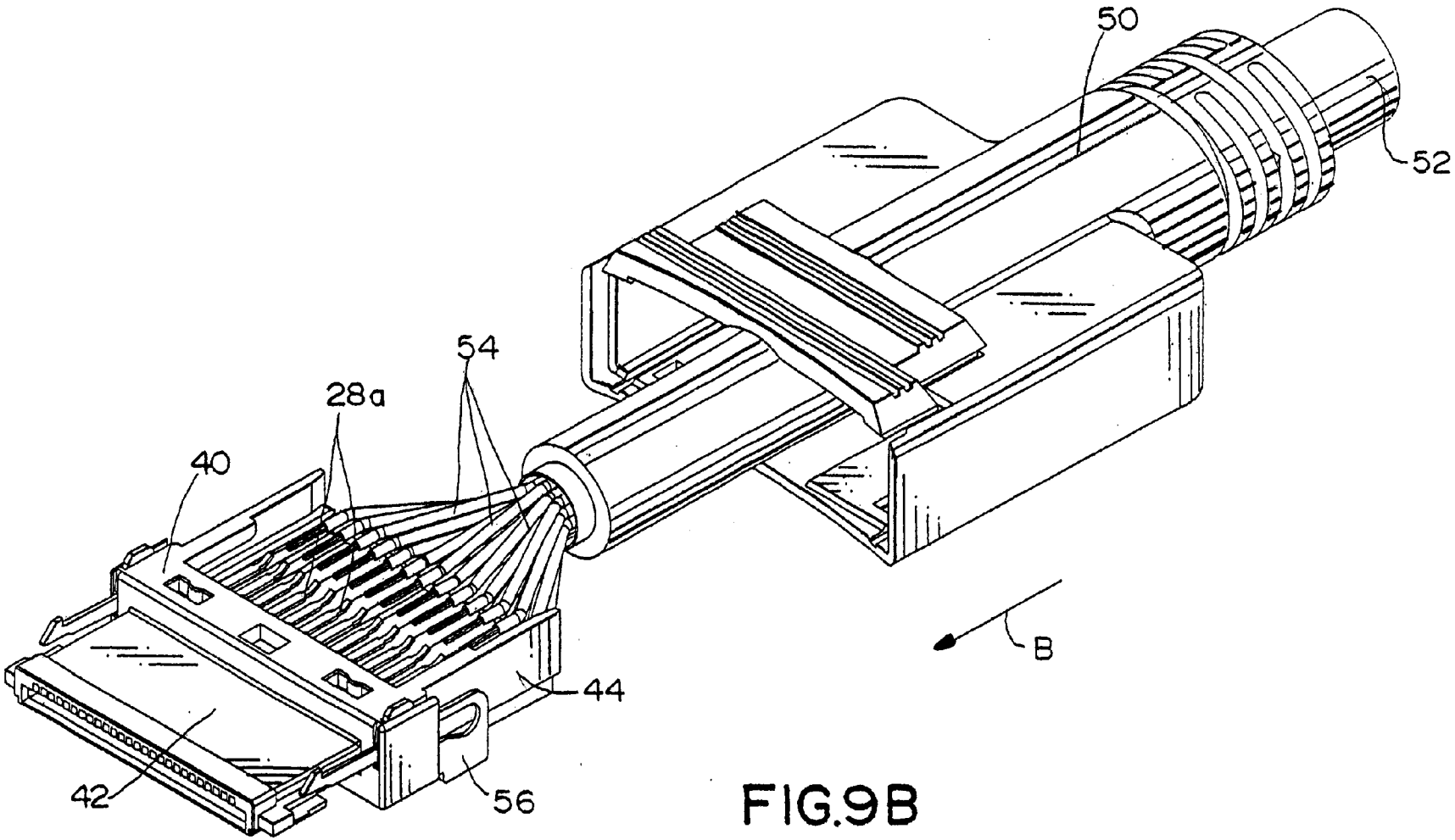

The subassembly of FIG. 9A then can be assembled in an electrical connector as shown in FIG. 9B. Specifically, a boot 50 is slipped onto a multi-conductor cable 52. The cable includes a plurality of discrete electrical wires 54. The insulating cladding of the wires is removed to expose lengths of the conductive cores of the wires. The exposed cores then are soldered to conductors 48*a* of circuit board 48 to thereby electrically connect the conductive cores of the electrical wires of cable 52 to terminal portions 28*a* and 28*b* of terminal module 36 within the connector assembly. Boot 50 then is moved forwardly in the direction of arrow "B" into latching engagement with latches 56 to form the completed electrical connector assembly.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A method of manufacturing a terminal module, comprising the steps of:

stamping from a blank of metal material in a plane a plurality of elongated terminals having a single contact portion at a first end and a single terminal portion at a second end, the elongated terminals joined by a tie bar intermediate the first and second ends, each single terminal portion having a specific lateral distance in relation to another single terminal portion, the single contact portions of the elongated terminals are separated from each other by said stamping, and the single terminal portions of the plurality of elongated terminals joined by a carrier strip;

shearing said blank to separate said single terminal portions by forming edges defining lateral ends of each of said single terminal portions, each edge sharing a same shear line with other edges of the single terminal portions;

forming at least one of the single terminal portions in a second plane out of the plane of the blank of metal material while each of the single terminal portions maintain the specific lateral distance;

overmolding a dielectric housing about the terminals between the first end and the tie bar thereof, with the tie bar being located outside the housing; and cutting the tie bar to separate the elongated terminals.

2. The method of claim 1 wherein said forming step further includes forming the single terminal portion of at least some of said plurality of elongated terminals to one side of the blank of metal material.

3. The method of claim 2 wherein the second end of the elongated terminals remain joined after said stamping step by the carrier strip with finger portions projecting therefrom, and said forming step further includes forming at least some of the finger portions out of the plane of the blank of metal material on the one side thereof of the single terminal portions of said at least some of said plurality of elongated terminals, whereby the at least some finger portions provide support for a transport sheet and protect the elongated terminal portions.

4. The method of claim 3, including a step of severing said carrier strip and finger portions after said overmolding step.

* * * * *